US009022511B2

(12) United States Patent
Mizutani

(10) Patent No.: US 9,022,511 B2
(45) Date of Patent: May 5, 2015

(54) RECORDING APPARATUS AND IMAGE RECORDING METHOD

(75) Inventor: Seigo Mizutani, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 364 days.

(21) Appl. No.: 13/571,729

(22) Filed: Aug. 10, 2012

(65) Prior Publication Data

US 2013/0038656 A1 Feb. 14, 2013

(30) Foreign Application Priority Data

Aug. 11, 2011 (JP) ..... 2011-176204

(51) Int. Cl.
*B41J 29/38* (2006.01)
*B41J 11/00* (2006.01)

(52) U.S. Cl.
CPC ..... *B41J 11/002* (2013.01); *B41J 11/0095* (2013.01)

(58) Field of Classification Search
CPC ..... B41J 11/002
USPC ..... 347/16, 102, 104
See application file for complete search history.

(56) References Cited

U.S. PATENT DOCUMENTS

2002/0001006 A1* 1/2002 Matsumoto et al. ..... 347/16
2009/0085998 A1* 4/2009 Kubota et al. ..... 347/102
2011/0050824 A1 3/2011 Toya et al.

FOREIGN PATENT DOCUMENTS

JP 2011-046096 3/2011

* cited by examiner

*Primary Examiner* — Manish S Shah
*Assistant Examiner* — Jeffrey C Morgan
(74) *Attorney, Agent, or Firm* — Workman Nydegger

(57) ABSTRACT

An image recording apparatus includes a transport unit which transports a medium with a joint portion along a transport path, a head unit which performs recording of a printing image on both the joint portion and a non-joint portion by ejecting ink onto the medium, a heating unit which dries liquid forming the printing image by heating a portion of the medium located at a heating region on the transport path, a detection unit which detects the joint portion, and a controller which controls transporting of the medium by the transport unit so that a heating time of the joint portion in the heating region becomes longer than a heating time of the non-joint portion in the heating region on the basis of a detection signal from the detection unit.

4 Claims, 10 Drawing Sheets

| | 1 FRAME PRINTING TIME (= DRY TIME) [SECONDS] | DRY TIME WHEN DETECTING JOINT PORTION [SECONDS] | EXTENDED DRY TIME WHEN DETECTING JOINT PORTION [SECONDS] |
|---|---|---|---|
| 4 PASSES | 10 | 35 | 25 |
| 6 PASSES | 15 | 35 | 20 |
| 8 PASSES | 20 | 35 | 15 |

FIG. 10A
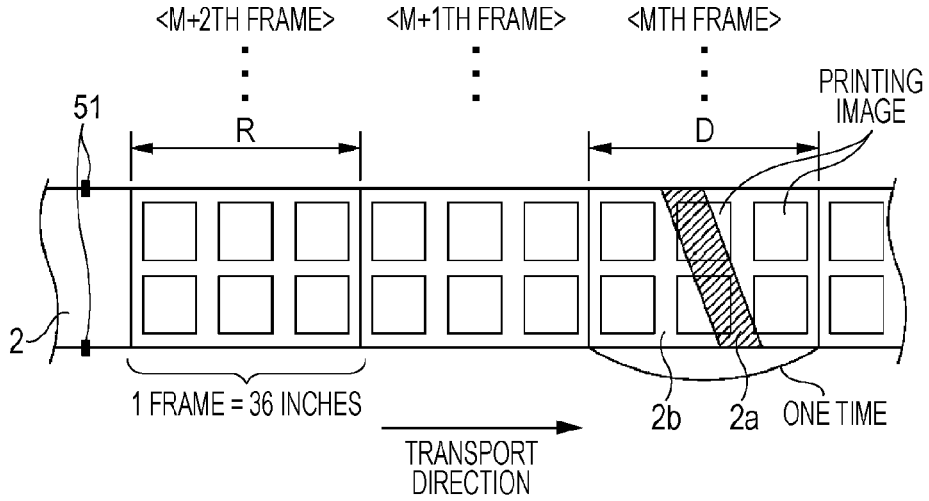
FIG. 10B
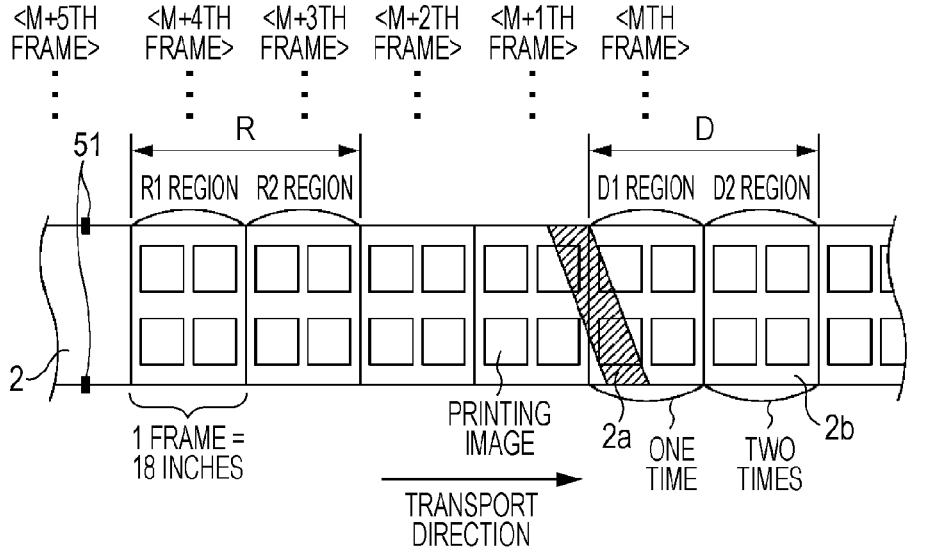
FIG. 10C
| | PRINTING TIME IN 4 PASSES PRINTING (=DRY TIME) [SECONDS] | DRY TIME WHEN DETECTING JOINT PORTION [SECONDS] | EXTENDED DRY TIME WHEN DETECTING JOINT PORTION [SECONDS] |
|---|---|---|---|
| 36 INCHES | 10 SECS. × ONE TIME | 35 | 25 SECS. × ONE TIME |
| 18 INCHES | 5 SECS. × TWO TIMES | 35 | 12. 5 SECS. × TWO TIMES |

RECORDING APPARATUS AND IMAGE RECORDING METHOD

BACKGROUND

1. Technical Field

The present invention relates to an image recording apparatus and an image recording method.

2. Related Art

As an example of an image recording apparatus, an ink jet printer which performs printing by ejecting liquid such as ink onto a medium such as paper has been known. The ink jet printer includes a transport unit which transports the medium along a transport path, a head unit which records a print image at a portion of the medium which is located at an image recording region on the transport path, and a dry unit which dries a portion of the medium which is located at a dry area on the transport path (for example, JPA-2011-46096).

In such an ink jet printer, when recording a printing image on a medium with a joint portion, it is possible to perform recording on both the joint portion and portions other than the joint portion (hereinafter, refer to as "a non-joint portion").

However, when drying the medium after recording the printing image, there is a concern that a dry time for the joint portion may be insufficient, and the joint portion is not sufficiently dried, since the joint portion and the non-joint portion are dried without being distinguished therebetween.

SUMMARY

An advantage of some aspects of the invention is to provide an image printing apparatus which is able to successfully dry a medium after recording an image by securing a dry time with respect to a joint portion of the medium.

According to an aspect of the invention, there is provided an image recording apparatus which includes, a transport unit which transports a medium with a joint portion along a transport path; a head unit which performs recording of a printing image on both the joint portion and a non-joint portion by ejecting liquid onto the medium; a heating unit which dries liquid forming the printing image by heating a portion of the medium located at a heating region on the transport path; a detection unit which detects the joint portion; and a controller which controls transporting of the medium by the transport unit so that a heating time of the joint portion in the heating region becomes longer than a heating time of the non-joint portion in the heating region on the basis of a detection signal from the detection unit.

Another aspect of the invention will be clarified by descriptions of this application and accompanying drawings.

BRIEF DESCRIPTION OF THE DRAWINGS

The invention will be described with reference to the accompanying drawings, wherein like numbers reference like elements.

FIG. 10A is a diagram which shows a specific example in a case where the rolled paper is intermittently transported in a unit of 36 inches. FIG. 10B is a diagram which shows a specific example in a case where the rolled paper is intermittently transported in a unit of 18 inches. FIG. 10C is a table which shows a relationship between a frame size and the dry time.

DESCRIPTION OF EXEMPLARY EMBODIMENTS

Figure 1:
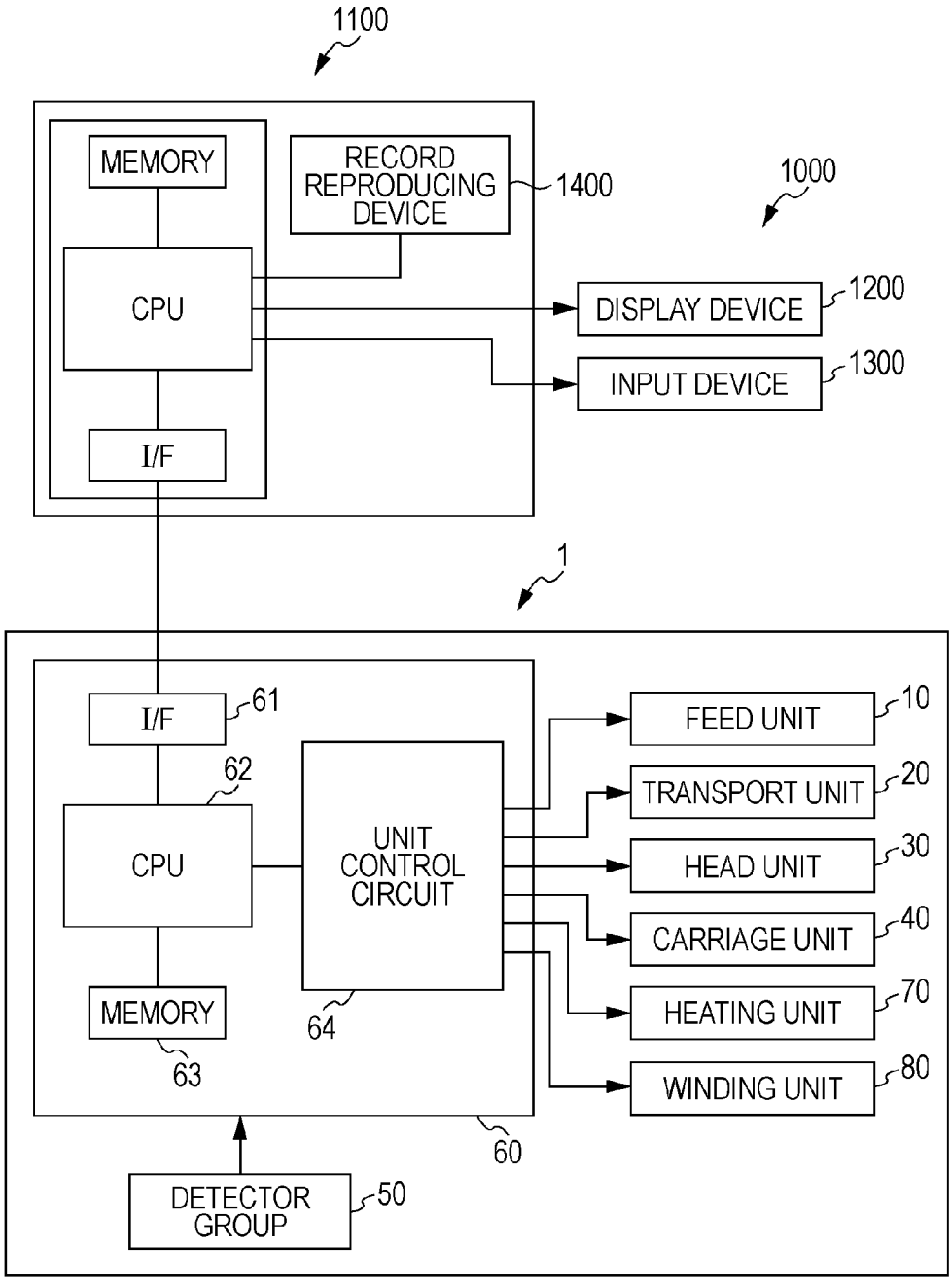
FIG. 1 is a block diagram which shows a configuration of a printing system.

At least the following matters will be clarified by descriptions of the specification and accompanying drawings.

According to an aspect of the invention, there is provided an image recording apparatus which includes, a transport unit which transports a medium with a joint portion along a transport path; a head unit which performs recording of a printing image on both the joint portion and a non-joint portion by ejecting ink onto the medium; a heating unit which dries liquid forming the printing image by heating a portion of the medium located at a heating region on the transport path; a detection unit which detects the joint portion; and a controller which controls transporting of the medium by the transport unit so that a heating time of the joint portion in the heating region becomes longer than a heating time of the non-joint portion in the heating region on the basis of a detection signal from the detection unit.

In the image recording apparatus, it is possible to successfully dry the medium with the joint portion by securing a dry time with respect to the joint portion in order to make the dry time of the joint portion longer than that of the non-joint portion.

In the image recording apparatus, the transport unit may intermittently transport the medium in the transport direction, and the heating unit may heat the joint portion when the joint portion is located at the heating region at the time of moving and stopping the medium; the head unit may perform printing operation by ejecting liquid onto a portion of the medium which is located at an image recording region on the transport path by performing a plurality of reciprocation along the transport direction while the heating unit is heating the joint portion which is located at the heating region when the medium is stopped; the heating unit may continuously heat the joint portion for a predetermined time even after the printing operation is completed, and the transport unit may restart transporting of the medium thereafter; and the controller may change the predetermined time according to the number of reciprocations.

According to the image recording apparatus, it is possible to effectively dry the medium with the joint portion.

In the image recording apparatus, the transport unit may intermittently transport the medium along the transport direction in a unit of frame, and the heating unit may heat the joint portion when the medium is moving and stopping at the time of locating of the joint portion at the heating region; the head unit may perform the printing operation by ejecting liquid onto a portion of the medium which is located at the position on the image recording region on the transport path while the heating unit is heating the joint portion located on the heating region when the medium is stopped; the heating unit may continuously heat the joint portion for a predetermined time, even after the printing operation is completed, and the transport unit may restart transporting of the medium thereafter; and the controller may change the predetermined time according to the size of the unit of frame.

According to image recording apparatus, it is possible to effectively dry the medium with the joint portion.

In the image recording apparatus, the transport unit may intermittently transport the medium along the transport direction in a unit of frame, and the heating unit may heat the joint portion when the medium is moving and stopping at the time of locating of the joint portion at the heating region; the head unit may perform the printing operation by ejecting liquid onto the portion of the medium which is located at the position on the image recording region on the transport path while the heating unit is heating the joint portion located on the heating region when the medium is stopped; the heating unit may continuously heat the joint portion for a predetermined time, even after the printing operation is completed, and the transport unit may restart transporting of the medium thereafter; and the controller may cause the head unit to execute a flusing operation while the heating unit continuously heats the joint portion for the predetermined time even after the printing operation is completed.

According to the image recording apparatus, it is possible to suppress a printing failure which occurs due to clogging of nozzles, or the like, by effectively using the dry time of the joint portion.

In the image recording apparatus, the joint portion may include a material which is different from that of the non-joint portion, and may be a film.

According to the image recording apparatus, it is possible to appropriately dry the medium with the joint portion depending on the material thereof.

According to another aspect of the invention, there is provided an image recording method which includes, preparing for an image recording apparatus including a transport unit which transports a medium with a joint portion along a transport direction, a head unit which records a printing image on both the joint portion and a non-joint portion by ejecting liquid onto the medium, a heating unit which dries a liquid forming the printing image by heating a portion of the medium which is located at a heating region on the transport path, a detection unit which detects the joint portion, and a controller; and controlling transporting of the medium by the transport unit so that a heating time of the joint portion in the heating region becomes longer than a heating time of the non-joint portion in the heating region on the basis of a detection signal from the detection unit.

According to the image recording method, it is possible to successfully dry the medium with the joint portion by securing a dry time with respect to the joint portion, since a heating time of the joint portion is longer than that of the non-joint portion.

According to the image recording method, the joint portion may include a material which is different from that of the non-joint portion, and may prepare for a medium of which the material is film.

According to the image recording apparatus, it is possible to appropriately dry the medium with the joint portion according to the material.

In the following embodiments, an ink jet printer 1 as the image printing apparatus (hereinafter, referred to as "printer 1") will be described as an example.

Embodiments

Configuration of Printing System

FIG. 1 is a diagram which describes a configuration of a printing system 1000. The printing system 1000 according to the embodiment includes a printer 1, a host computer 1100 as a printing control device, a display device 1200, an input device 1300, and a recording reproducing device 1400.

The host computer 1100 is connected to the printer 1, the display device 1200, the input device 1300, and the recording reproducing device 1400 so as to be able to perform a data communication using a wire such as a cable, or wirelessly. The computer device 1100 includes an interface unit for performing data transmission and reception between the printer 1, a CPU as an arithmetic processing unit for performing control of the entire host computer 1100, and a memory on the computer side which secures an area for storing a program such as a printer driver, a work area, or the like, creates printing data of an image to be printed by the printer 1, and outputs the data to the printer 1.

The display device 1200 displays a user interface such as an application program, or a printer driver.

The input device 1300 is configured by, for example, a keyboard, or a mouse, and is used when operating the application program, or setting the printer driver according to a user interface which is displayed on the display device 1200.

The recording device 1400 is configured by, for example, a flexible disk drive, or a CD-ROM drive.

The host computer 1100 according to the embodiment is installed with the print driver. The printer driver is a program for executing a function of converting image data from the application program to printing data, in addition to executing a function of displaying the user interface on the display device 1200. The printer driver is stored in a variety of storage mediums (a computer-readable recording medium, or the like) such as a flexible disk, or a CD-ROM. Alternatively, the printer driver can be downloaded through various communication means such as the Internet.

Printer Driver

Figure 2:
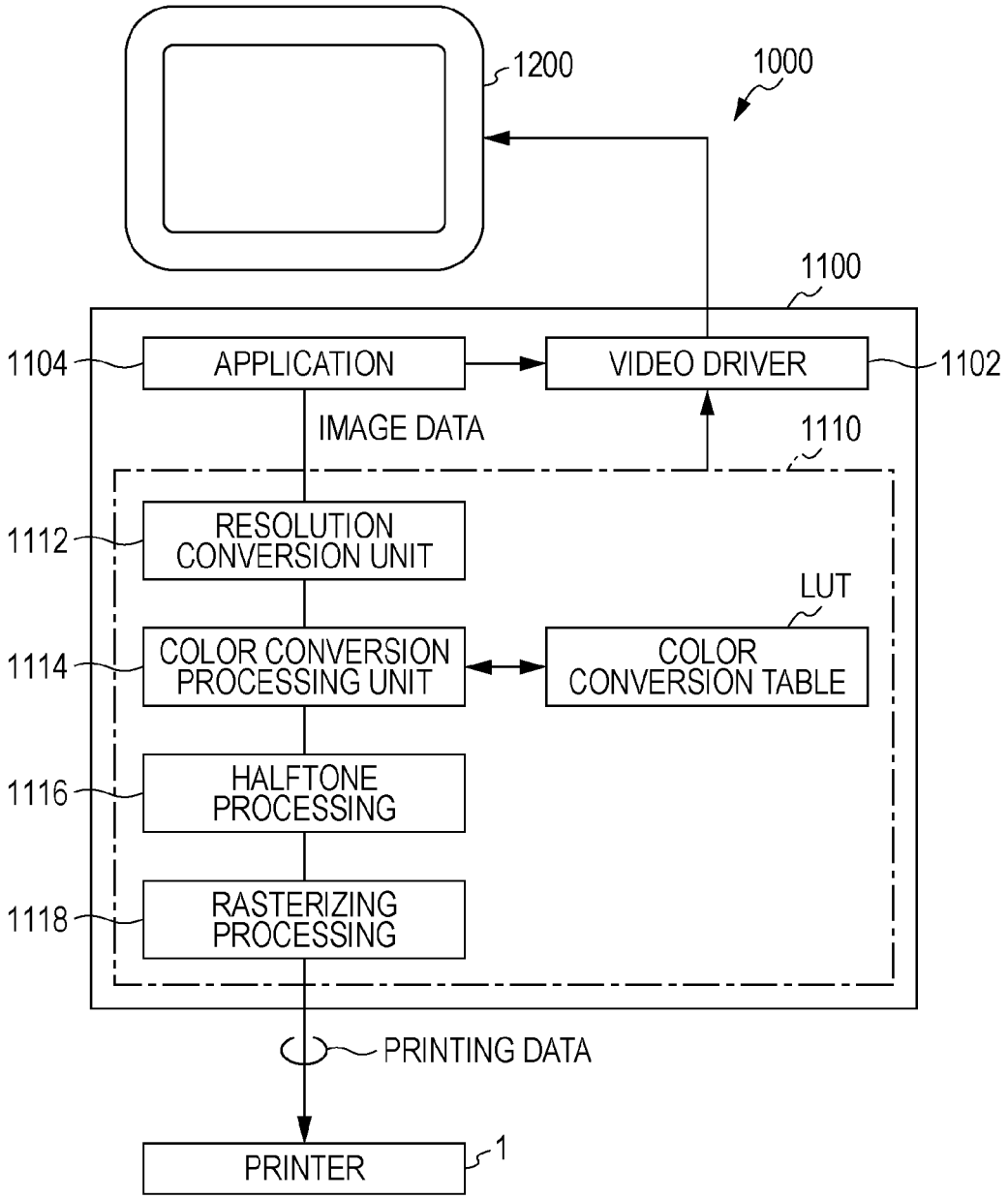
FIG. 2 is an explanatory diagram which describes schematic processing performed by a printing driver.

FIG. 2 is a diagram which schematically describes basic processing which is performed by the printer driver.

In the host computer 1100, computer programs such as a video driver 1102, or the application program 1104, and the printer driver 1110 are operated under an operating system which is mounted on the host computer 1100. The video driver 1102 has a function of displaying, for example, the user interface or the like on the display device 1200 according to a display command from the application program 1104, or the printer driver 1110. The application program 1104, for example, has a function of performing image editing or the like, and creates data (image data) relating to an image. A user is able to give an instruction of printing the image edited by the application program 1104 through the user interface of the application program 1104. The application program 1104 outputs image data to the printer driver 1110 when receiving the instruction of printing.

The printer driver 1110 receives the image data from the application program 1104, converts the image data to printing data, and outputs the printing data to the printer 1. Here, the printing data is data having a format which can be interpreted by the printer 1, and data having various command data, and pixel data. In addition, the command data is data for instructing an execution of a specified operation to the printer 1. In addition, the pixel data is data relating to pixels which configure a printed image (printing image), and data relating to dots (data relating to color, or size of dots) which are formed at a position on a medium corresponding to a pixel.

The printer driver 1110 includes a resolution conversion processing unit 1112, a color conversion processing unit 1114, a half-tone processing unit 1116, and a raster line processing unit 1118 in order to convert the image data output from the application program 1104 to the printing data. Hereinafter, various processes which are performed by each processing unit 1112, 1114, 1116, and 1118 of the printer driver 1110.

The resolution conversion processing unit 1112 performs resolution conversion processing in which the image data (test data, image data, or the like) which is output from the application program 1104 is converted to a resolution at the time of performing printing on the medium. In the resolution conversion processing, for example, when a resolution at the time of printing the image on the medium is set to 720×720 dpi, the image data received from the application program 1104 is converted to image data with a resolution of 720×720 dpi. In addition, the image data after the resolution conversion processing is RGB data having a multi-grayscale (for example, grayscales of 256) which is expressed by an RGB color space. Hereinafter, the RGB data which is created by performing resolution conversion processing with respect to the image data is referred to as RGB image data.

The color conversion processing unit 1114 performs color conversion processing in which the RGB data is converted to CMYK data which is expressed in a CMYK color space. In addition, the CMYK data is data corresponding to an ink color which is included in the printer 1. The color conversion processing is performed by the printer driver 1110 by referring to a table (color conversion look-up table LUT) in which grayscale values of the RGB image data and grayscale values of the CMYK image data are associated with each other. By the color conversion processing, the RGB data in each pixel is converted to the CMYK data corresponding to the ink color. In addition, the data after the color conversion processing is the CMYK data having 256 grayscales which is expressed in the CMYK color space. Hereinafter, the CMYK data in which the RGB image data is subject to the color conversion processing is referred to as CMYK image data.

The halftone processing unit 1116 performs halftone processing in which data with a large grayscale number is converted to data with a grayscale number which can be formed by the printer 1. The halftone processing is processing in which, for example, data expressing 256 grayscales is converted to one-bit data expressing two grayscales, or two-bit data expressing four grayscales. In the halftone processing, pixel data is created so that the printer 1 can form dots by distributing the dots using a dither method, a gamma correction, an error diffusion method, or the like. When performing the halftone processing, the halftone processing unit 1116 refers to a dither table when using the dither method, refers to a gamma table when using the gamma correction, and refers to an error memory for storing the diffused error when performing the error diffusion method. Data which is subject to the halftone processing has the same resolution as that of the above described RGB data (for example, 720 dpi×720 dpi). The data subject to the halftone processing is configured, for example, by one-bit data, or two-bit data for each pixel.

A rasterizing processing unit 1118 performs rasterizing processing in which image data having a matrix shape is changed in order of data to be transmitted to the printer 1. In this manner, the data subject to the rasterizing processing is output to the printer 1.

Regarding Setting of Printer Driver

The user interface of the printer driver 1110 will be described.

The user interface of the printer driver 1110 is displayed on the display device 1200 through a video driver 1102. A user is able to perform various setting of the printer driver 1110 such as a printing mode, a resolution of an image to be printed (interval between dots when printing, 720 dpi, 1440 dpi, or the like), a type of medium to be used in printing (plain paper, coated paper, a film or the like), a type of image to be printed (color printing, monochrome printing, or the like), or the like, by using the input device 1300.

According to the embodiment, when a user sets a resolution of a printing image on a set screen, the printer driver 1110 forms printing data corresponding to the resolution. That is, the printing data includes image data with the set resolution, and command data which instructs reciprocation which is performed along the transport direction with respect to the head 31 to be described later so as to be operated by a number of times corresponding to the resolution. For example, in a case of a normal resolution, the command data is set so that the head 31 (carriage 42) performs the reciprocation of four times in order to perform printing of four passes. In a case of a high resolution, the command data is set so that the head 31 (carriage 42) performs the reciprocation of eight times in order to perform printing of eight passes.

In addition, when a user sets a frame size in the set screen, the printer driver 1110 automatically performs imposition of the printing image, and creates printing data according to the frame size. That is, the printing data includes image data of the printing image to be imposed, and command data which instructs a transport unit 20 to be described later to intermittently transport the rolled paper 2 along the transport direction in each of the frame. For example, when the frame size is set to 36 inches, command data which instructs the transport unit 20 to perform the intermittent transport in a unit of 36 inch is set.

Here, the frame means a unit of transport of the rolled paper 2 to be intermittently transported, and a printing range in which the printing image is recorded onto the rolled paper 2 while the intermittent transport is interrupted. In the printer 1 according to the embodiment, the maximum size of one frame is set to 36 inches.

Regarding Configuration Example of Printer 1

Figure 3:
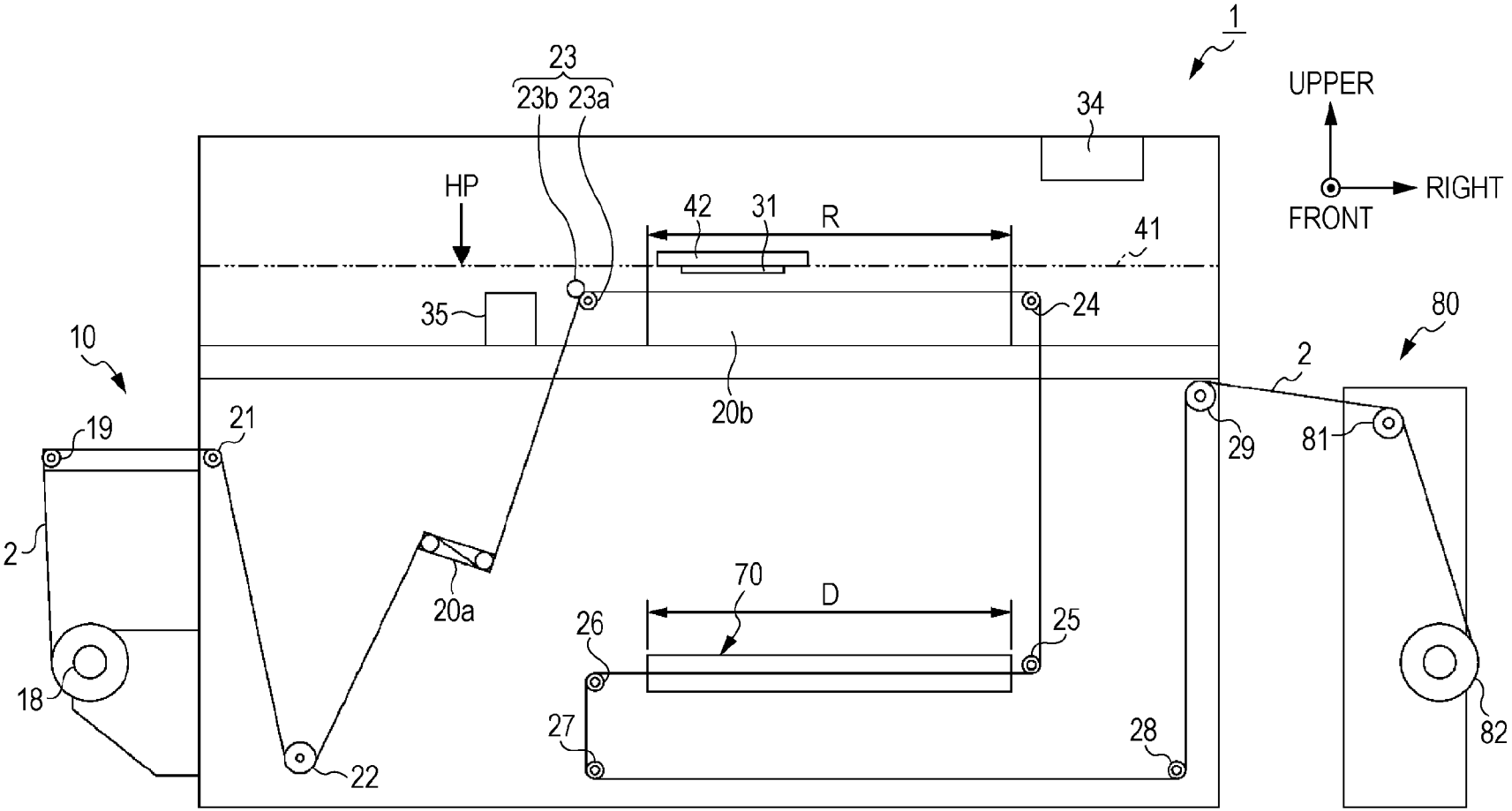
FIG. 3 is a schematic diagram which shows a configuration of a printer.

A configuration example of the printer 1 will be described using FIGS. 1 and 3. FIG. 3 is a schematic cross-sectional view of the printer 1.

In addition, in descriptions in below, when referring to "the vertical direction", or "the horizontal direction", it means that the direction which is denoted by arrows in FIG. 3 is the reference. In addition, when referring to "the front-back direction", it means that the direction is a direction which is orthogonal to the surface of paper, in FIG. 3.

In addition, according to the embodiment, as a recording medium on which the printer 1 records an image, paper which is wound up into a roll, or a film (hereinafter, referred to as rolled paper (continuously fed paper)) will be exemplified.

As shown in FIGS. 1 and 3, the printer 1 according to the embodiment includes a transport unit 20 as an example of the transport unit, a feed unit 10 along the transport path in which the transport unit 20 transports the rolled paper 2, a positioning unit 20*a*, a platen 20*b*, a heating unit 70 as an example of the heating unit which heats the medium in the heating region D on the transport path, and a winding unit 80. Further, the printer 1 includes a head unit 30 as an example of the head unit which performs image recording in the image recording region R on the transport path, a carriage unit 40 as an example of a head moving unit, a controller 60 which controls these units or the like, and controls operations as the printer 1, and a detector group 50.

The feed unit 10 is a unit which feeds the rolled paper 2 to the transport unit 20. The feed unit 10 includes a winding shaft 18 at which the rolled paper 2 is wound, and is rotatably supported, and a relay roller 19 which guides the rolled paper 2 which is fed from the winding shaft 18 to the transport unit 20 by winding the rolled paper up.

The transport unit 20 is a unit which transports the rolled paper 2 which is sent by the feed unit 10 along the preset transport path. As shown in FIG. 3, the transport unit 20 includes a relay roller 21 which is located on the horizontally right with respect to the relay roller 19, a relay roller 22 which is located at the obliquely right lower part when seen from the relay roller 21, a first transport roller 23 which is located at the obliquely right upper part when seen from the relay roller 22, a second transport roller 24 which is located at the right part when seen from the first transport roller 23, a relay roller 25 which is located at the vertical lower part when seen from the second roller 24, and a relay roller 26 which is located at the vertical upper part when seen from the relay roller 25, a relay roller 27 which is located at the vertical lower part when seen from the relay roller 26, a relay roller 28 which is located on the right side when seen from the relay roller 27, and a sending-out roller 29 which is located at the vertical upper part when seen from the relay roller 28.

The positioning unit 20*a* which adjusts a position of the roller paper 20 in the width direction (the front-back direction shown in FIG. 3) is provided at a region which is located along the transport path between the relay roller 22 and the first transport roller 23. In addition, the platen 20*b* which supports a portion of the rolled paper 2 located at the image recording region R on the transport path is provided at a region which is located along the transport path between the first transport roller 23 and the second transport roller 24. In addition, the heating unit 70 which is located at the heating region D on the transport path is provided at a region which is located along the transport path between the relay roller 25 and the relay roller 26.

The relay roller 21 is a roller which loosens the rolled paper 2 which is sent from the relay rollers 21 and 19 toward the lower part by winding the rolled paper up from the left side.

The relay roller 22 is a roller which transports the rolled paper 2 which is sent from the relay roller 21 toward the obliquely right upper part by winding the rolled paper up from the left side.

The first transport roller 23 includes a first driving roller 23*a* which is driven by a motor which is not shown, and a first driven roller 23*b* which is arranged so as to face the first driving roller 23*a* by interposing the rolled paper 2 therebetween. The first transport roller 23 is a roller which transports the rolled paper 2 which is loosened toward the lower part to the image recording region R which faces the platen 20*b* by lifting the rolled paper up to the upper part. The first transport roller 23 temporarily stops transporting while image printing with respect to a portion of the rolled paper 2 on the image recording region R. In addition, a transport amount (length of a portion of the rolled paper) of the rolled paper 2 which is located on the platen 20*b* is adjusted when the first driven roller 23*b* is rotated along with rotational driving of the first driving roller 23*a* by a driving control of the controller 60.

The second transport roller 24 is a roller which is driven by the motor which is not shown, and transports a portion of the rolled paper 2 after being recorded with an image by the head unit 30 in the horizontal direction along the supporting surface of the platen 20*b*, and then transports to the vertical lower part. In addition, by the driving control of the controller 60, a predetermined tension which is applied to the portion of the rolled paper 2 located on the platen 20*b* is adjusted by the rotational driving of the second transport roller 24.

The relay roller 25 is a roller which transports the rolled paper 2 which is sent from the second transport roller 24 to the left side from the upper part by winding the rolled paper up from the upper part. The rolled paper 2 of which the transport direction is converted by the relay roller 25 is supplied to the heating unit 70.

The relay roller 26 is a roller which transports the rolled paper 2 which is sent from the relay roller 25 to the vertical lower part by winding the rolled paper up from the right side.

The relay roller 27 is a roller which transports the rolled paper 2 which is sent from the relay roller 26 to the right side by winding the rolled paper up from the upper part.

The relay roller 28 is a roller which transports the rolled paper 2 which is sent from the relay roller 27 toward the vertical upper part by winding the rolled paper up from the left side.

The transport direction of the rolled paper after being heated by the heating unit 70 is converted by these relay rollers 26, 27, and 28, and is moved toward the sending-out roller 29.

The sending-out roller 29 sends out the rolled paper 2 which is sent from the relay roller 28 to the winding unit 80 by winding the rolled paper up from the left lower part.

In this manner, the transport path for transporting the rolled paper 2 is configured when the rolled paper 2 moves by sequentially passing through each roller. That is, the rolled paper 2 is intermittently transported by the transport unit 20 along the transport path in the frame unit.

The head unit 30 is a unit which is caused to eject ink at a portion of the rolled paper 2 which is sent to the image recording region R (on the platen 20*b*) on the transport path by the transport unit 20. The head unit 30 includes a head 31, and a valve unit 34.

The head 31 includes nozzle columns which are aligned in the column direction on the bottom face thereof. According to the embodiment, the nozzle columns including a plurality of nozzles 1 to N, respectively, for each color of yellow (Y), magenta (M), cyan (C), and black (K) are provided. Each of nozzles 1 to N of each nozzle column is linearly arranged in the cross direction (column direction) which crosses the rolled paper 2 in the transport direction. Each nozzle column is arranged in parallel with intervals each other along the transport direction.

A piezoelectric element (not shown) as a driving element for ejecting ink droplets is provided in each of nozzles 1 to N. The piezoelectric element expands according to an applying time of a voltage when the voltage of the predetermined time width is applied between electrodes which are provided at both ends thereof, and deforms the side wall of an ink flow path. In this manner, a volume in the ink flow path contracts according to an expansion and contraction of the piezoelectric element, and ink corresponding to the amount of contraction is ejected from the each of nozzles 1 to N of each color as ink droplets.

Figure 4:
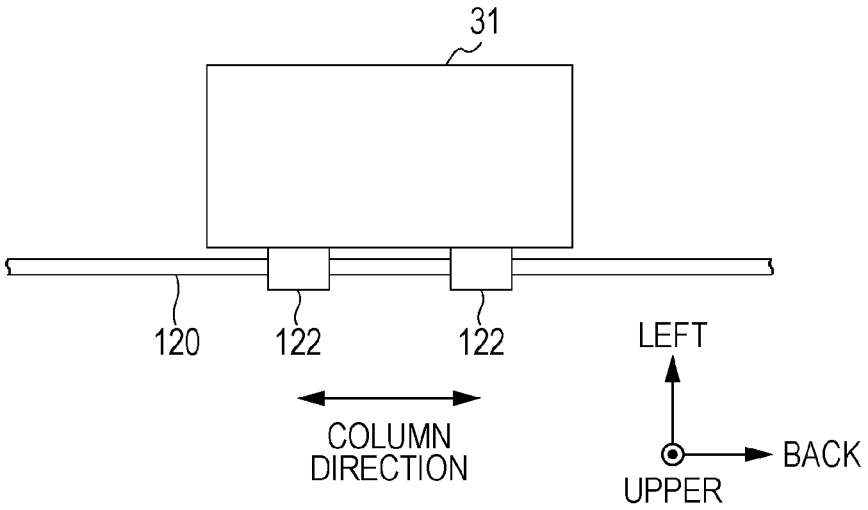
FIG. 4 is an explanatory schematic diagram which describes a configuration example of moving a head in the column direction.

In addition, the head 31 is able to reciprocate in the transport direction (horizontal direction) and in the column direction. Specifically, as shown in FIG. 4, a ball screw for head 120 as a sending screw is arranged on the right side of the head 31 along the column direction. In addition, the head 31 is fixed with a ball screw engaging member 122, accordingly, the ball screw for head 120 is attached to the head 31 through the ball screw engaging member 122. In addition, when the ball screw for head 120 is rotated, the head 31 is moved in the column direction. In addition, a head guide rail, though not shown, is provided, and the head guide rail guides a movement in the column direction of the head 31 by the ball screw for head 120.

The valve unit 34 is a unit for temporarily storing the ink, and is connected to the head 31 through a ink supply tube which is not shown. For this reason, the head 31 is able to perform the image printing by ejecting ink which is supplied from the valve unit 34 toward a portion of the rolled paper 2 in a state of being transported onto the platen 20*b* from the nozzle, and being stopped.

The carriage unit 40 is a unit which moves the head 31. The carriage unit 40 includes a guide rail 41 (denoted by a two-dotted dashed line in FIG. 3) which extends in the horizontal direction, a carriage 42 which is supported to be able to reciprocate in the horizontal direction (transport direction of the rolled paper 2) along the guide rail 41, and a motor which is not shown.

The carriage 42 is configured so as to move by being integrated with the head 31 when the motor (not shown) is driving. A position of the carriage 42 (head 31, or each nozzle column) in the guide rail 41 (position in the horizontal direction) can be obtained by detecting the rising edge and falling edge in a pulse signal which is output from an encoder which is provided at the motor (not shown), and counting the edge by the controller 60.

In addition, the carriage 42 moves to the upstream side (upstream side in the transport direction when seen from the platen 20*b*) in the transport direction along the guide rail 41 by being integrated with the head 31, and stops at the home position HP where cleaning is performed when performing the cleaning of the head 31 after the image printing (refer to FIG. 3).

A cleaning unit (not shown) is provided at the home position HP. The cleaning unit includes a cap, a suction pump, or the like. When the carriage 42 is located at the home position HP, the cap which is not shown is stuck to the bottom face (nozzle surface) of the head 31. When the suction pump (not shown) is operated in such a state where the cap is stuck, the ink in the head 31 is sucked together with thickened ink and paper dust. In this manner, the cleaning of the head is completed when the clogged nozzle is recovered from a non-ejecting state.

In addition, at the time of performing flushing of the head 31 after the image printing, the carriage 42 moves toward the home position HP from the platen 20*b* by being integrated with the head 31. At this time, the head 31 performs the flushing operation in a flushing unit 35 which is arranged between the platen 20*b* and the home position Hp while moving along with the carriage 42.

The flushing unit 35 is a unit for causing the head 31 to perform the flushing operation, and includes a flushing box for storing the ink ejected from the nozzle at the time of flushing. The flushing is maintenance for recovering the nozzle so as to prevent the nozzle from clogging due to thickening of ink in the vicinity of the nozzle, or prevent the ink of an appropriate amount from not being ejected due to air bubbles mixed into the nozzle. Specifically, it is an operation in which the ink is forcibly ejected from each nozzle by applying a driving signal which is not related to a printing image to be printed onto the rolled paper 2 to the piezoelectric element.

The heating unit 70 is a unit which is provided at the heating region D on the downstream side of the image recording region R on the transport path, and dries the ink which forms the printing image by heating a portion of the rolled paper 2 which is sent to the heating region D by the transport unit 20. The heating unit 70 is a drying furnace which is formed by arranging a heater (not shown) having nichrome wire therein, and in which the nichrome wire itself is heating by being electrified, and is able to conduct the heat to the portion of the rolled paper 2 (rolled paper 2 in the drying furnace) which is located at the heating region D. Since the heater is configured by building the nichrome wire in the entire region of the heating unit 70, it is possible to conduct the heat uniformly with respect to the portion of the rolled paper 2 located at the heating region D. For this reason, it is possible to dry the plurality of ink droplets which is landed onto the portion of the rolled paper 2 evenly.

The winding unit 80 is a unit which winds the rolled paper 2 (rolled paper which is performed with the image printing) transported by the transport unit 20. The winding unit 80 includes a relay roller 81 for transporting the rolled paper 2 which is sent from the sending-out roller 29 to the obliquely right lower part by winding the rolled paper up from the left upper side, and a winding driving shaft 82 for winding the rolled paper 2 which is rotatably supported, and is sent from the relay roller 81.

The controller 60 is a control unit which controls the printer 1. As shown in FIG. 1, the controller 60 includes an interface unit 61, a CPU 62, a memory 63, and a unit control circuit 64. The interface unit 61 is a unit which performs a transmission and reception of data between a host computer 1100 as an external device and the printer 1. The CPU 62 is an arithmetic processing unit which performs the entire control of the printer 1. The memory 63 is a memory which secures an area for storing programs of the CPU 62, or a work area, or the like. The CPU 62 controls each unit using a unit control circuit 64 in accordance with the programs stored in the memory 63.

The detector group 50 is a unit for monitoring a situation in the printer 1, and there are, for example, a rotary-type encoder which is used for controlling transporting of the rolled paper 2 which is attached to the transport roller or the like, a sheet detection sensor for detecting the presence of the transported rolled paper 2, a linear-type encoder for detecting a position of the carriage 42 (or the head 31) in the moving direction (horizontal direction), a joint portion detection sensor 51 for detecting the joint portion 2*a* of the rolled paper 2, or the like.

Regarding Joint Portion

Figure 5A:
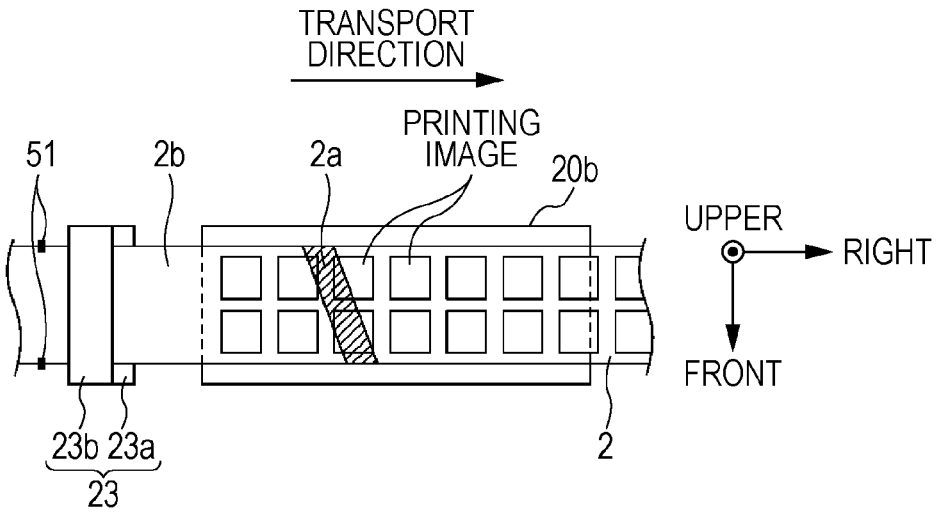
FIG. 5A is a diagram which shows a state where rolled paper on a platen is seen from above (a plan view of the rolled paper).
Figure 5B:
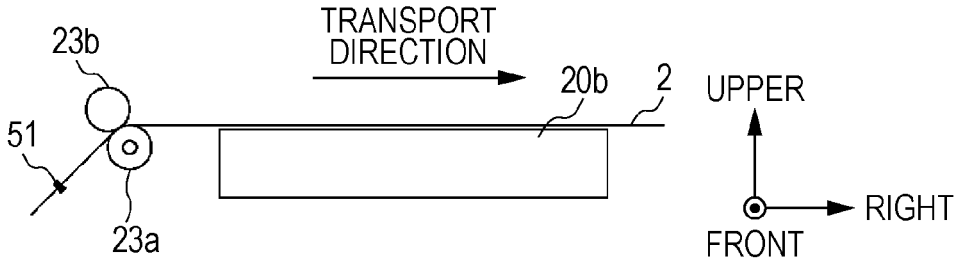
FIG. 5B is a diagram which shows a state where the rolled paper on the platen is seen in the front-back direction.

Here, the joint portion 2*a* of the rolled paper 2 will be described using FIGS. 5A and 5B. FIGS. 5A and 5B are diagrams which describe the joint portion 2*a* of the rolled paper 2. Here, a state where the rolled paper 2 on the platen 20*b* is seen in the horizontal direction (plan view of the rolled paper 2) is shown in FIG. 5A, and a state where the rolled paper 2 on the platen 20*b* is seen in the front-back direction (side view of the rolled paper 2) is shown in FIG. 5B.

As shown in FIG. 5A, the rolled paper 2 according to the embodiment includes the joint portion 2*a* and the non-joint portion 2*b*. The joint portion 2*a* is a portion for forming one rolled paper in which an end portion of one rolled paper and one end portion of the other rolled paper are integrated by being jointed. In addition, as shown in FIGS. 5A and 5B, the joint portion 2*a* is detected by a joint portion detection sensor 51 as an example of the detection unit. The joint portion detection sensor 51 according to the embodiment includes a pair of light emitting element and light receiving element, and is able to detect the joint portion 2*a* when infrared light is radiated to the joint portion 2*a* from the light emitting element, and the infrared light which is reflected on the joint portion 2*a* is received by the light receiving element. The non-joint portion 2*b* is portions of the rolled paper other than the joint portion 2*a*.

According to the embodiment, as shown in FIG. 5A, in order to perform recording on both the joint portion 2*a* and the non-joint portion 2*b*, it is possible to impose the printing image which is continuous at regular intervals without forming a useless blank portion on the rolled paper 2.

Here, the joint portion 2*a* according to the embodiment is formed of a film (for example, a red color film), and has a material different from the non-joint portion 2*b* which is formed of paper. Since the film has low water absorbency, when forming the printing image by ejecting ink to both the joint portion 2*a* and the non-joint portion 2*b*, the ink landed onto the joint portion 2*a* is hard to be fixed compared to the non-joint portion 2*b*. That is, a dry time until the ink landed onto the joint portion 2*a* is dried tends to be longer than that of the ink landed onto the non-joint portion 2*b*.

However, in the printer in the related art, since the joint portion 2*a* and the non-joint portion 2*b* are dried without being distinguished when drying the rolled paper 2 after recording the printing image, there has been a concern that the dry time of the joint portion 2*a* may be insufficient, and it is difficult to sufficiently dry the joint portion.

In contrast to this, in the printer 1 according to the embodiment, it is controlled such that the joint portion 2*a* is detected by the joint portion detection sensor 51, and the dry time of the joint portion 2*a* is set to be longer than that of the non-joint portion 2*b*. As a result, even when the printing image is recorded in both the joint portion 2*a* and the non-joint portion 2*b*, it is possible to successfully dry the rolled paper 2 after recording the printing image.

Hereinafter, an operation example of the printer 1 which is performed in order to successfully dry the rolled paper 2 with the joint portion 2*a* after recording the printing image will be specifically described.

Regarding Operation Example of Printer 1

Image Forming Method

As described above, the printer 1 according to the embodiment is provided with the head 31 having nozzle columns in which nozzles are aligned in the column direction (front-back direction). In addition, image recording of one page (for one frame) is performed at a portion of the rolled paper 2 on the image recording region R when the controller 60 causes the nozzles to eject ink, and forms raster lines which are formed along the transport direction (horizontal direction) while moving the head 31 in the transport direction (horizontal direction).

Here, the controller 60 according to the embodiment executes printing of a plurality of passes (4 passes, 6 passes, 8 passes, or the like). That is, the printing is performed by changing the position of the head 31 in the column direction little by little in each pass, in order to increase a resolution of an image in the column direction. In addition, as an image forming method, for example, a well-known interlace printing is performed.

Figure 6:
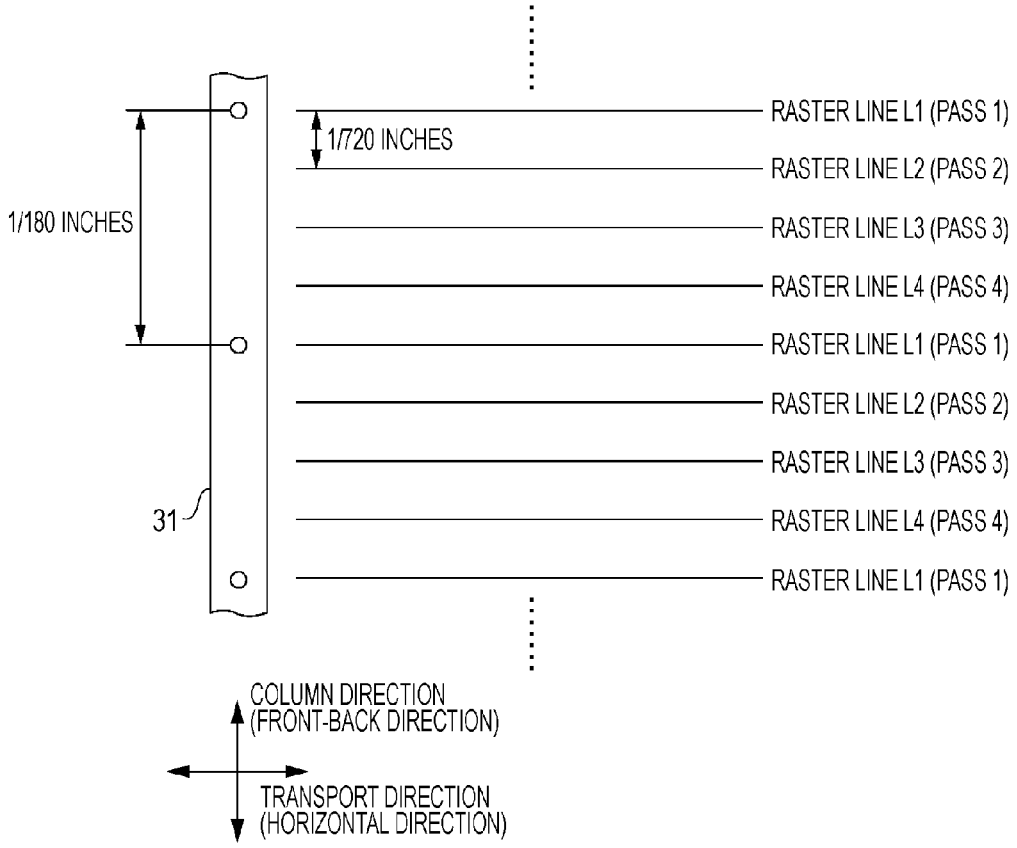
FIG. 6 is a schematic view which shows raster lines which are formed in each pass in a case where printing is performed using four passes.

Regarding this, more specific descriptions will be made using FIG. 6. FIG. 6 is a schematic diagram which shows raster lines which are formed in each pass in a case where printing is performed using 4 passes.

The nozzle columns (nozzles) of the head 31 are denoted on the left side in FIG. 6, and the raster lines are formed when ink is ejected from the nozzles while the head 31 (nozzle column) is moving in the transport direction. The position of the head 31 (nozzle column) in the column direction in the figure is the position at the time of a first pass, and when the head 31 (nozzle column) is moved in the transport direction while maintaining the position, printing of one pass is performed, and three raster lines shown in the figure are formed (raster line L1 denoted by pass 1 at the right end).

In addition, subsequently, when the head 31 (nozzle column) is moved in the column direction, and is moved in the transport direction while maintaining the position after moving, printing of 2 passes is performed, and two raster lines (raster line L2) shown in the figure are formed. In addition, since the interlace printing is adopted, the raster line L2 which is close to the raster line L1 is formed using ink which is ejected from a nozzle different from the nozzle from which the ink which has formed the raster line L1 is ejected. For this reason, a moving distance of the head 31 in the column direction is not ¼ ($1/180 \times 1/4 = 1/720$ inches) of the distance between nozzles (for example, $1/180$ inches), and become larger than this.

Hereinafter, printing of third to fourth passes is performed by performing the same operation, and the remaining raster lines shown in the figure (raster lines L3 to L4) are formed. In this manner, it is possible to make the resolution of an image in the column direction be a resolution of four times (=720÷180) by forming raster line with 4 passes. Similarly, since it is possible to make a resolution of six times in a case where the printing is performed using 6 passes, and a resolution of eight times in a case where the printing is performed using 8 passes, it is possible to further increase a resolution of an image by increasing the number of passes.

Regarding a Series of Operations with Respect to Frame

Figure 7:
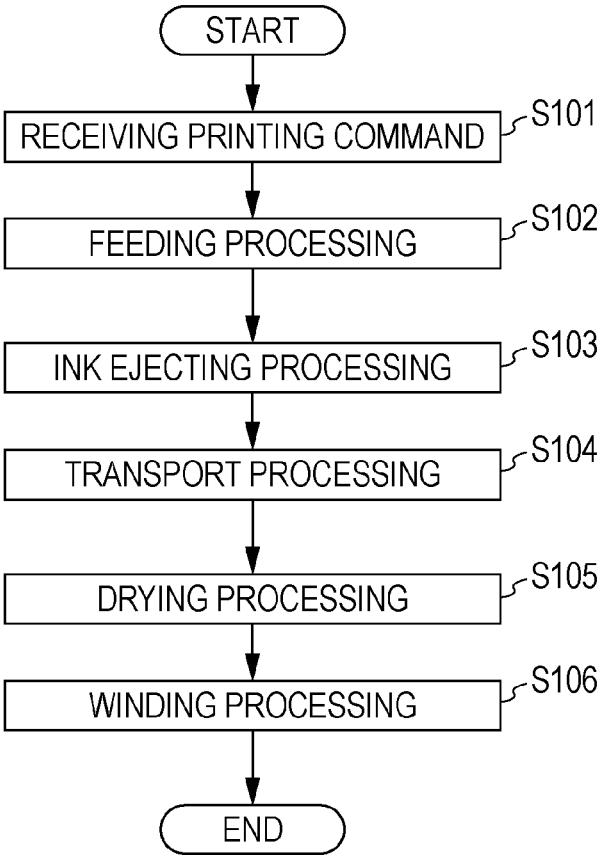
FIG. 7 is a flowchart which describes a series of operations which are performed in each frame by the printer.

Subsequently, a series of operations which is performed by the printer 1 with respect to one frame will be described using FIG. 7 by focusing on the frame among frames of the rolled paper 2. FIG. 7 is a flowchart which describes a series of operations which is performed by the printer 1 in each frame.

In addition, a variety of operations of the printer 1 is executed mainly by the controller 60. In particular, according to the embodiment, the operations are executed when the CPU 62 processes a program which is stored in the memory 63. In addition, the program is configured by codes for performing the variety of operations to be described in below.

The controller 60 receives a printing command from the host computer 1100 through the interface unit 61 (S101).

The printing command is included in a header of printing data which is transmitted from the host computer 1100.

In addition, the controller 60 interprets contents of the variety of commands which are included in the received printing data, and performs the following processing or the like using each unit.

First, the controller 60 performs feeding processing (S102).

The feeding processing is processing in which the rolled paper 2 is fed to the platen 20*b* side along the transport direction, and positioning of a print start position (referred to as a start position, as well) is performed.

The controller 60 drives a transport motor, transports the rolled paper 2 along the transport direction by rotating the transport roller 23, and performs positioning of the roller paper 2 at a print start position. In this manner, a portion of the roller paper 2 which becomes the first printing target (frame as a printing target, and hereinafter referred to as "the frame") is set in a state where the portion is stopped at the image recording region R (on the platen 20*b*).

Subsequently, the controller 60 performs ink ejecting processing with respect to the portion (the frame) of the rolled paper 2 which is stopped at the image recording region R (S103).

The ink ejecting processing is processing in which the ink is intermittently ejected from the head 31 which is moving along the transport direction (horizontal direction), and dots are formed on the portion (the frame) of the rolled paper 2 on the platen 20*b*.

The controller 60 drives a carriage motor, and moves the carriage 42 which is located at the home position HP along the transport direction. That is, the carriage 42 (head 31) repeatedly performs reciprocating along the transport direction according to the number of passes.

In addition, the controller 60 causes the head 31 to eject ink based on the printing data while the carriage 42 is moving.

In this manner, ejected ink droplets are landed onto the rolled paper, and the printing image is formed when the head 31 ejects the ink while repeating the reciprocating along the transport direction.

Subsequently, the controller 60 performs transport processing (S104).

The transport processing is processing in which the portion of the rolled paper 2 after being recorded with the printing image thereon (the frame after being printed with the image in S103) is intermittently moved along the transport direction in a unit frame. The controller 60 rotates the transport roller 23 by driving the transport motor, and moves the rolled paper 2 in the transport direction by a movement amount (for example, 36 inches) corresponding to the frame size.

Due to this transport processing, the portion of the roller paper 2 after being recorded with the printing image (the frame after being printed with the image in S103) is released from the stopped state in the image recording region R, and moves toward the heating region D on the downstream side from the image recording region R.

Subsequently, the controller 60 performs dry processing (S105).

The dry processing is processing in which the portion of the rolled paper 2 (the frame after being printed with the image in S103) which is transported by the transport processing, and has reached the heating region D thereon is heated by the heating unit 70, and the ink forming the printing image on the frame is dried.

Figure 8:
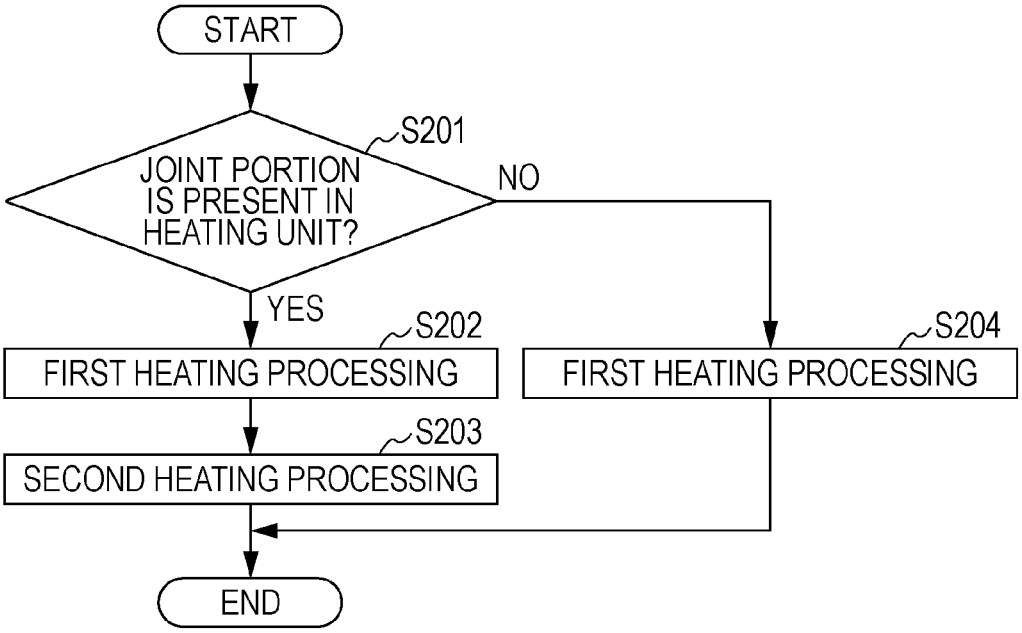
FIG. 8 is a flowchart which describes dry processing.

Regarding this, it will be more specifically described using FIG. 8. FIG. 8 is a flowchart which describes the dry processing.

First, the controller 60 determines whether or not the joint portion 2*a* is present at the portion of the rolled paper 2 (the frame after being printed with the image in S103) on the heating region D (S201).

More specifically, when the joint portion 2*a* passes through the joint portion detection sensor 51 along with the transport of the rolled paper 2 by the transport unit 20 (refer to FIG. 5A), the controller 60 receives a detection signal from the joint portion detection sensor 51. As a result, the controller 60 is able to recognize that the joint portion 2*a* reaches the image recording region R. Thereafter, the controller 60 is able to recognize that when the joint portion 2*a* on the image recording region R will reach the heating region D by counting the number of intermittent transporting times, since the rolled paper 2 is intermittently transported in the unit frame. According to the embodiment, it is set such that the controller 60 is able to recognize that the joint portion 2*a* has reached the heating region D when two times of the intermittent transport in the unit frame is performed in a state where the joint portion 2*a* is on the image recording region R.

Subsequently, when the joint portion 2*a* is present at the heating region D (S201: YES), the controller 60 performs first heating processing in which the joint portion 2*a* is heated by the heating unit 70 while the printing operation is performed with respect to a portion of the rolled paper 2 (another frame which is different from the frame) in a state of being stopped on the image recording region D (S202).

Even when the first heating processing is completed, the ink landed onto the joint portion 2*a* is not completely dried. For this reason, the controller 60 continuously performs second heating processing in which the joint portion 2*a* is heated for a predetermined time by the heating unit 70 even after the printing operation in the image recording region R is completed (S203).

When the second heating processing is completed, the dry time with respect to the joint portion 2*a* is extended, and the ink landed onto the joint portion 2*a* becomes a dried state. Thereafter, the controller 60 restarts the transport by the transport unit 20, and the portion of the rolled paper 2 which has stopped in the heating unit 70 (the frame after drying) is moved toward the downstream side from the heating region D.

In addition, a specified example of the second heating processing will be described in detail later.

In this manner, when the joint portion 2*a* is detected, since it is possible to sufficiently secure the dry time with respect to the joint portion 2*a*, it is possible to successfully dry the rolled paper 2 even when the printing image is recorded on both of the joint portion 2*a* and the non-joint portion 2*b* of the rolled paper 2.

On the other hand, when the joint portion 2*a* is not present at the heating region D (S201: NO), only the above described first heating processing is performed (S204). At this time, since the non-joint portion 2*b* is present at the heating region D, the heating unit 70 performs the heating with respect to the non-joint portion 2*b* for a shorter time than the heating time of the joint portion 2*a* in order to dry the ink landed onto the non-joint portions 2*b*.

Subsequently, returning to FIG. 7, the controller 60 performs winding processing (S106).

The winding processing is processing in which the portion of the rolled paper 2 after drying (the frame after drying) is wound up by the winding unit 80. The controller 60 drives a winding motor, and winds the portion of the rolled paper 2 after drying up by rotating the winding shaft 82.

Thereafter, the controller 60 moves the carriage 42 to the home position HP when the series of operations is completed.

Specific Example 1 of Second Heating Processing

Figures 9A, 9B:
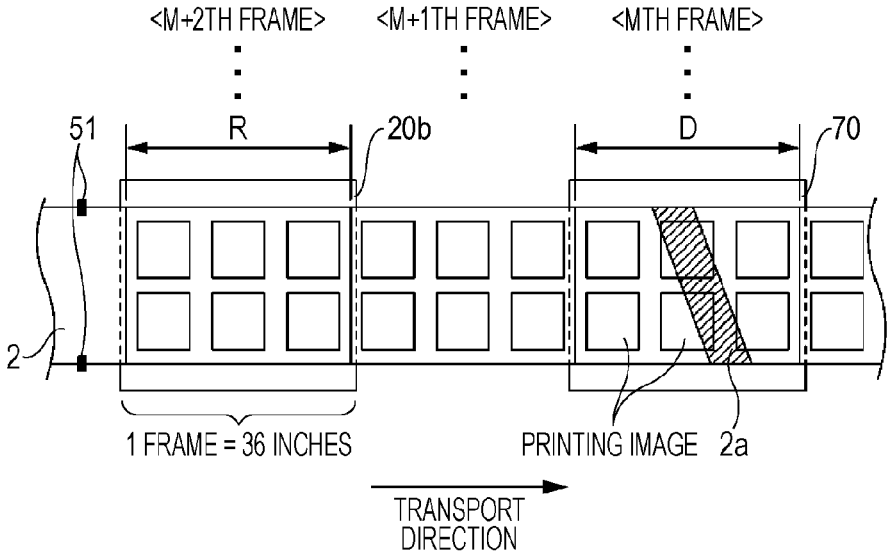
FIG. 9A is a diagram which shows a state in which a portion of the rolled paper which is continuous along a transport path is extracted from an image recording region to a heating region, and is linearly developed.
FIG. 9B is a table which shows a relationship between the number of passes and a dry time.

Here, in the above described second heating processing, a case where the predetermined time of heating the joint portion 2*a* is changed according to the number of reciprocation which is performed by the head 31 will be described using FIGS. 9A and 9B. FIG. 9A is a diagram which shows a state where a portion from the image recording region R to the heating region D of the rolled paper 2 which is continuous along the transport path is extracted, and is linearly developed. FIG. 9B is a table which denotes a relationship between the number of passes and the dry time.

According to the embodiment, as shown in FIG. 9A, the size of one frame is 36 inches, and the rolled paper 2 is intermittently transported along the transport direction in the frame unit (in every 36 inches). That is, the rolled paper passes through the image recording region R (platen 20*b*) in order of Mth frame, M+1th frame, and M+2th frame by the intermittent transport to the transport direction of the transport unit 20, and then sequentially passes through the heating region D in this order.

The Mth frame is in a state of reaching the heating region D by the second intermittent transport into the transport direction from a state of being stopped at the image recording region R after passing through the joint portion detection sensor 51, and is stopped at the heating region D. The Mth frame includes the joint portion 2*a*. Accordingly, the joint portion 2*a* is in a state of being stopped at the heating region D, as well.

The M+1th frame is the subsequent frame to the Mth frame, and is in a state of reaching a position between the heating region D and the image recording region R by the first intermittent transport in the transport direction from the state of being stopped at the image recording region R, and is stopped at the position.

The M+2th frame is the subsequent frame to the M+1th frame, and is in a state of being stopped at the image recording region R after passing through the joint portion detection sensor 51.

Here, the dry processing of the joint portion 2*a* will be described by focusing on the joint portion 2*a* having the Mth frame.

As shown in FIG. 8, in the dry processing of the joint portion 2*a*, a first dry processing (S202), and a third dry processing (S203) are executed.

First, in the first heating processing, the heating unit 70 heats the joint portion 2*a* which is located at the heating region D when the Mth frame is stopped. In the mean time, the head 31 performs the printing operation by ejecting ink to the M+2th frame which is located at the image recording region R by performing a plurality of reciprocating along the transport direction. In addition, the number of reciprocating performed by the head 31 is set based on the command data which is included in the printing data.

For example, when the command data is set so as to perform the printing using 4 passes (refer to FIG. 6), the joint portion 2*a* is heated by the heating unit 70 while the head 31 performs the reciprocating four times along the transport direction.

Here, as shown in FIG. 8B, when the printing is performed using 4 passes, it takes 10 seconds for completing the printing operation. That is, since the printing time in the image recording region R is the same as the dry time in the heating region D, the heating time (dry time) of the joint portion 2*a* becomes 10 seconds. In addition, when the printing is performed using 8 passes, the joint portion 2*a* is heated for 15 seconds while the head 31 performs the reciprocating six times along the transport direction. In addition, the printing is performed using 6 passes, the joint portion 2*a* is heated for 20 seconds while the head 31 performs the reciprocating eight times along the transport direction.

In addition, as shown in FIG. 8B, the dry time which is necessary for drying the joint portion 2*a* (dry time to be secured) becomes 35 seconds in any of 4 passes, 6 passes, and 8 passes. Accordingly, when the printing is performed using 4 passes, a dry time of 25 seconds is insufficient (35 seconds-10 seconds=25 seconds). When the printing is performed using 6 passes, a dry time of 20 seconds is insufficient (35 seconds–15 seconds=20 seconds). In addition, when the printing is performed using 8 passes, a dry time of 15 seconds is insufficient (35 seconds–20 seconds=15 seconds).

In this manner, since the dry time is insufficient in every pass, when the first heating processing is completed, the ink ejected to the joint portion 2*a* is in a state of not being dried yet.

Accordingly, since it is necessary to extend the dry time in order to dry the ink ejected onto the joint portion 2*a*, the second heating processing is started after completing the first heating processing.

Subsequently, in the second heating processing, the heating unit 70 continuously heats the joint portion 2*a* which is located at the heating region D by a predetermined time while the Mth frame is stopped. In the mean time, the head 31 (carriage 42) stands by at the home position HP since the printing operation with respect to the M+2th frame which is located at the image recording region R is completed (refer to FIG. 3).

The predetermined time (extended dry time) is set to 25 seconds since 25 seconds of dry time is insufficient at the time of completing the first heating processing when the printing is performed using 4 passes. Similarly, the predetermined time when printing is performed using 6 passes is set to 20 seconds, and is set to 15 seconds, when the printing is performed using 8 passes.

Accordingly, when the predetermined time has passed in the second heating processing, the ink ejected onto the joint portion 2*a* is in a state of being dried.

In this manner, it is possible to effectively dry the ink landed onto the joint portion 2*a* by extending the dry time with respect to the joint portion 2*a* in the second heating processing according to the number of passes (number of times of reciprocating).

In addition, the head 31 may perform flushing operation while the joint portion 2*a* is heated for the predetermined time in a state where the Mth frame is stopped in the second heating processing. In this manner, it is possible to effectively use the dry time of the joint portion 2*a* without making the dry time as a waiting time of the head 31, and to suppress a printing failure which occurs due to nozzle clogging or the like.

Specific Example 2 of Second Heating Processing

Subsequently, in the above described second heating processing, a case where the predetermined time of heating the joint portion 2*a* is changed according to the size of the frame unit will be described using FIGS. 10A to 10C. FIG. 10A shows a specific example in a case where the size of one frame is set to 36 inches, and the rolled paper 2 is intermittently transported in the frame unit. FIG. 10B shows a specific example in a case where the size of one frame is set to 18 inches, and the rolled paper 2 is intermittently transported in the frame unit. FIG. 10C is a table which denotes a relationship between the frame size and the dry time.

According to the embodiment, as shown in FIGS. 10A and 10B, the rolled paper 2 is intermittently transported in the transport direction in the frame unit. That is, by the intermittent transport in the transport direction by the transport unit 20, the Mth frame, the M+1th frame, and the M+2th frame . . . pass through the image recording region R in this order, and then sequentially pass through the heating region D in this order. In addition, the frame unit of the intermittently transported rolled paper 2 is set based on the command data included in the printing data.

As shown in FIG. 10A, when the rolled paper 2 is intermittently transported for every 36 inches, the Mth frame reaches the heating region D by the second intermittent transport in the transport direction in a state of being stopped at the image recording region R after passing through the joint portion detection sensor 51, and stops at the heating region D. In addition, the Mth frame includes the joint portion 2*a*. Accordingly, the joint portion 2*a* is in a state of being stopped at the heating region D, as well.

As shown in FIG. 8, the dry processing of the joint portion 2*a* in the case is performed with the first heating processing (S202) and the second heating processing (S203), however, this is similar to the case of performing the printing using 4 passes in the above described specific example 1 (refer to FIGS. 9A and 9B). That is, as shown in FIG. 10C, when the intermittent transport is performed by 36 inches (printing using 4 passes), the first heating processing of one time is performed for 10 seconds with respect to the joint portion 2*a*, and the second heating processing of one time is performed for 25 seconds. As a result, when the second heating processing is completed, it is possible to make the ink ejected onto the joint portion 2*a* being sufficiently dried, since the dry time 35 seconds which is necessary to dry the ink landed onto the joint portion 2*a* has passed.

On the other hand, as shown in FIG. 10B, when the rolled paper 2 is intermittently transported by 18 inches, the Mth frame passes through the image recording region R by the intermittent transport of two times in the transport direction after passing through the joint portion detection sensor 51, and reaches the heating region D by further the intermittent transport of three times. Thereafter, the Mth frame passes through the heating region D by the intermittent transport of two times.

As shown in FIG. 10B, the Mth frame and the M+1th frame respectively include the joint portion 2*a*. That is, the joint portion 2*a* is formed on the rolled paper 2 by being laid across the two frames. Accordingly, at the time of completing the dry processing with respect to the Mth frame and the M+1th frame, the dry processing with respect to the joint portion 2*a* is completed.

In this manner, when the intermittent transport is performed by 18 inches, the joint portion 2*a* is continuously detected when the Mth frame and the M+1th frame passes through the joint portion detection sensor 51, and the dry processing with respect to the joint portion 2*a* is performed. In addition, in the dry processing, the joint portion 2*a* is heated by the heating unit 70 while repeating a plurality of times of moving and stopping in the heating region D.

Here, the dry processing with respect to the joint portion will be described by focusing on the joint portion 2*a* which is laid across the continuous two frames.

As shown in FIG. 10B, since the size of the heating region D is 36 inches, when the rolled paper 2 is intermittently transported by 18 inches, the dry processing with respect to the Mth frame in the heating region D is performed by dividing into two times. That is, since the Mth frame includes the joint portion 2*a*, the dry processing with respect to the joint portion 2*a* is performed by dividing into two times, as well.

As shown in FIG. 8, the first heating processing (S202) and the second heating processing (S203) are performed in the dry processing of the joint portion 2*a*.

According to the embodiment, when the rolled paper 2 is intermittently transported by 18 inches, the first heating processing of first time and the second heating processing of first time, and the first heating processing of second time and the second heating processing of second time are performed with respect to the joint portion 2*a*.

First, as shown in FIG. 10B, when the Mth frame stops at the heating region D (D1 region on the upstream side in the transport direction), the first heating processing of first time is performed. In the first heating processing of first time, the heating unit 70 heats the joint portion 2*a* which is located at the D1 region. On the other hand, the head 31 performs the printing operation by ejecting ink with respect to the M+4th frame which is located at the image recording region R (R1 region on the upstream side in the transport direction) by performing a plurality of reciprocation along the transport direction during the first heating processing of first time. That is, the printing operation is not performed with respect to the M+3th frame which is located at the image recording region R (R2 region on the downstream side in the transport direction). In addition, the number of times of the reciprocation which is performed by the head 31 is set based on the command data which is included in the printing data. Here, it is assumed that the command data in a case of performing the printing using 4 passes is set.

After completing the printing operation with respect to the M+4th frame, the head 31 (carriage 42) stands by at the home position HP (refer to FIG. 3). In addition, the first heating operation of first time is completed simultaneously with the completion of the printing operation, and the second heating operation of first time is started. In the second heating processing of first time, the heating unit 70 continuously heats the joint portion 2*a* located at the D1 region only for a predetermined time. In the mean time, since the printing operation with respect to the M+4th frame located at the region R1 is completed, the head 31 is in a state of standing by at the home position HP. In addition, when the second heating processing of first time is completed, the Mth frame reaches the heating region (D2 region on the downstream side in the transport direction) by the intermittent transport by the transport unit 20. In addition, by the intermittent transport, the M+1th frame reaches the D1 region, the M+4th frame reaches the R2 region, and the subsequent M+5th frame reaches the R1 region.

Subsequently, when the Mth frame is stopped at the D2 region, the first heating processing of second time is performed. In the first heating processing of second time, the heating unit 70 heats the joint portion 2*a* which is located at the D2 region. On the other hand, the head 31 performs the printing operation by ejecting ink with respect to the M+5th frame located at the R1 region by performing the plurality of reciprocation along the transport direction while the first heating processing of second time is performed. That is, the printing operation is not performed with respect to the M+4th frame which is located at the R2 region.

After completing the printing operation with respect to the M+5th frame, the head 31 (carriage 42) stands by at the home position HP (refer to FIG. 3). In addition, the first heating processing of second time is completed simultaneously with the completion of the printing operation, and the second heating processing of second time is started. In the second heating processing of two time, continuously, the heating unit 70 heats the joint portion 2*a* located at the D2 region only for the predetermined time. In the mean time, since the printing operation with respect to the M+5th frame located at the R1 region is completed, the head 31 is in a state of standing by at the home position HP. In addition, when the second heating processing of second time is completed, the intermittent transport by the transport unit 20 is performed, and the Mth frame further moves to the downstream side from the heating region D.

In this manner, the dry processing with respect to the joint portion 2*a* which is included in the Mth frame has been described, however, the same dry processing is performed with respect to the joint portion 2*a* included in the M+1th frame.

Here, the dry processing with respect to the joint portion 2*a* will be more specifically described.

As shown in FIG. 10C, when the printing is performed using 4 passes, a printing time during which second printing operations of two times (printing operation with respect to the M+4th frame and printing operation with respect to the M+5th frame) are completed is 5 seconds×2 times=10 seconds. That is, the printing time in the image recording region R (R1 region) is the same as the dry time in the heating region D (D1 region and D2 region), a total heating time (dry time) of the first and second time of the joint portion 2*a* in the first heating processing becomes 10 seconds.

In addition, as shown in FIG. 10C, when the intermittent transport is performed with an interval of 18 inches, the dry time which is necessary for drying the joint portion 2*a* (dry time to be secured) is 35 seconds. Accordingly, a dry time of 25 seconds (35 seconds−10 seconds=25 seconds) is insufficient.

In this manner, since the dry time for the joint portion 2*a* is insufficient, the ink ejected onto the joint portion 2*a* is in a state of not being dried only by repeating the first heating processing two times.

Accordingly, since it is necessary to extend the dry time in order to dry the ink ejected onto the joint portion 2*a*, the second heating processing of the first and second time is started after completing the respective first heating processing of the first and second time. In addition, in the respective second heating processing of the first and second time, the joint portion 2*a* is heated for a predetermined time.

The predetermined time (extended dry time) is set to 12.5 seconds (25 seconds/two times) per one time, since there is a shortage of 25 seconds in the dry time at the time of completing the first heating processing of the first and second time, and the second heating processing is performed by being divided into two times.

Accordingly, when the intermittent transport is performed with the interval of 18 inches, 5 seconds of the first heating processing of first time, and 12.5 seconds of the second heating processing of first time are performed, and 5 seconds of the first heating processing of second time, and 12.5 seconds of the second heating processing of second time are performed with respect to the joint portion 2*a* after the intermittent transport of 18 inches. As a result, when the second heating processing of second time is completed, the ink ejected onto the joint portion 2*a* is in a state of being sufficiently dried, since the necessary dry time 35 seconds for drying the ink ejected onto the joint portion 2*a* elapses.

In this manner, when the intermittent transport of 18 inches is performed, it is possible to make the extended dry time per one time in the second heating processing be shorter compared to a case of the intermittent transport of 36 inches. Accordingly, in the second heating processing, it is possible to effectively dry the ink ejected onto the joint portion 2*a* by changing the dry time of the joint portion 2*a* according to the size of the unit frame at the time of the intermittent transport.

In addition, in the above describe second heating processing, the head 31 may perform a flushing operation while the joint portion 2*a* is heated for the predetermined time in a state where the Mth frame (or M+1th frame) is stopped. In this manner, it is possible to effectively use the dry time of the joint portion 2*a* without making as the waiting time of the head 31, and to suppress the printing failure which occurs due to the nozzle clogging or the like.

In addition, in the above described second heating processing, the dry time 25 seconds which is insufficient when completing the first heating processing of the first and second times is uniformly divided, and the extended dry time per one time is set to be 12.5 seconds (25 seconds/two times), however, it is not limited to this. For example, it is possible to set such that the second heating processing of second time is set to be performed for 5 seconds by performing the second heating processing of first time for 20 seconds, or the second heating processing of second time is set to be performed for 15 seconds by performing the second heating processing of first time for 10 seconds.

Regarding Effectiveness of Printer 1 According to the Embodiment

As described above, the printer 1 according to the embodiment includes, the transport unit 20 which transports the rolled paper 2 having the joint portion 2*a* along the transport direction; the head unit 30 which records the printing image on both the joint portion 2*a* and the non-joint portion 2*b* by ejecting ink onto the rolled paper 2; the heating unit 70 which dries ink which forms the printing image by heating a portion of the rolled paper 2 which is located at the heating region D on the transport path; the joint portion detection sensor 51 which detects the joint portion 2*a*; and the controller 60 which controls the transport of the rolled paper 2 by the transport unit 20 such that the heating time of the joint portion 2*a* in the heating region D becomes longer than that of the non-joint portion 2*b* in the heating region D on the basis of the detection signal from the joint portion detection sensor 51. In addition, in this manner, it is possible to successfully dry the rolled paper 2 having the joint portion 2*a* since it is possible to secure the dry time with respect to the joint portion 2*a*, and to fix the ink which is landed onto the joint portion 2*a*.

In addition, the transport unit 20 intermittently transports the rolled paper 2 along the transport direction, the heating unit 70 heats the joint portion 2*a* when the joint portion 2*a* is located at the heating region D at the time of moving and stopping of the rolled paper 2, the head unit 30 perform the printing operation by ejecting ink to the portion of the rolled paper 2 which is located at the image recording region R on the transport path by performing the plurality of reciprocation along the transport direction while the heating unit 70 heats the joint portion 2*a* which is located at the heating region D when the rolled paper 2 is stopped, the heating unit 70 continuously heats the joint portion 2*a* for the predetermined time even after the printing operation is completed, thereafter, the transport unit 20 restarts the transport of the rolled paper 2, and the controller 60 changes the predetermined time according to the number of times of the reciprocation. For this reason, it is possible to effectively dry the rolled paper 2 having the joint portion 2*a*, since it is possible to change the dry time with respect to the joint portion 2*a* according to the printing operation of the head unit 30.

In addition, the transport unit 20 intermittently transports the rolled paper 2 along the transport direction in the frame unit, the heating unit 70 heats the joint portion 2*a* when the joint portion 2*a* is located at the heating region D at the time of moving and stopping of the rolled paper 2, the head unit 30 performs the printing operation by ejecting ink at the portion of the rolled paper 2 which is located at the image recording region R on the transport path while the heating unit 70 heats the joint portion 2*a* located at the heating region D when the rolled paper 2 is stopped, the heating unit 70 continuously heats the joint portion 2*a* for the predetermined time even after the printing operation is completed, thereafter, the transport unit 20 restarts the transport of the rolled paper 2, and the controller 60 changes the predetermined time according to the size of the frame unit. For this reason, it is possible to effectively dry the rolled paper 2 having the joint portion 2*a*, since it is possible to change the dry time with respect to the joint portion 2*a* according to the intermittent transport by the transport unit 20.

In addition, the transport unit 20 intermittently transports the rolled paper 2 along the transport direction, the heating unit 70 heats the joint portion 2*a* when the joint portion 2*a* is located at the heating region D at the time of moving and stopping of the rolled paper 2, the head unit 30 performs the printing operation by ejecting ink at the portion of the rolled paper 2 which is located at the image recording region R on the transport path while the heating unit 70 heats the joint portion 2*a* located at the heating region D when the rolled paper 2 is stopped, the heating unit 70 continuously heats the joint portion 2*a* for the predetermined time even after the printing operation is completed, thereafter, the transport unit 20 restarts the transport of the rolled paper 2, and the controller 60 causes the head unit 30 to perform the flushing operation while the joint portion 2*a* is heated for the predetermined time by the heating unit 70 even after the printing operation is completed. For this reason, it is possible to perform the flushing operation together during the dry time of the joint portion 2*a*, and to suppress the printing failure which occurs due to the nozzle clogging or the like.

In addition, the material of the joint portion 2*a* is different from that of the non-joint portion 2*b*, and is a film. For this reason, even when the material of the joint portion 2*a* is the film which is different from that of the non-joint portion 2*b*, it is possible to appropriately dry the rolled paper 2 having the joint portion 2*a* according to the material. In addition, the film of the joint portion 2*a* may be a film in which resin (for example, polyester resin, polyimide resin, or the like) is processed into a film shape, or a film in which metal (for example, aluminum, copper, or the like) is processed on a film using rolling or the like.

The Other Embodiment

In the embodiment, mainly the image recording device has been described, however, a disclosure of the image recording method or the like is included, as well. Further, the embodiments are for the purpose of facilitating the comprehension of the invention, and the invention is not construed by limiting to the embodiments. The invention may be changed and modified without departing from the scope of the invention, and it goes without saying that the equivalents thereof are included in the invention as a matter of course. In particular, the embodiment described below is included in the invention as well.

Image Recording Apparatus.

In the above described embodiments, the ink jet printer has been exemplified as the image recording apparatus, however, the image recording apparatus is not limited to this. For example, it may be an image recording apparatus in which another liquid other than the ink is ejected. It may be applied to a variety of image recoding apparatuses including a liquid ejecting head or the like which ejects a minute amount of liquid droplets. In addition, the liquid droplets mean a state of liquid which is ejected from the image recording apparatus, and includes a granular shape, a tear shape, or a thread shape leaving a trail. In addition, the liquid here may be a material which can be ejected by the image recording apparatus. For example, the material may include a material in a state of liquid phase, materials which flow such as a liquid body having high viscosity, or low viscosity, sol, gel water, and inorganic solvent, organic solvent, liquid, liquid resin, liquid metal (metallic melt) other than that, or materials in which particles of a functional material which is formed of a solid body such as a pigment or metal particles are melted, diffuse, or mixed in a solvent, not only as liquid as a state of the material. In addition, as a representative example of the liquid, the ink, liquid crystal, or the like can be exemplified as described in the above embodiments. Here, the ink includes general water-based ink and oil-based ink, and a variety of liquid compositions such as gel ink, hot-melt ink, or the like. As specific examples of the image recoding apparatus, they may be an image recoding apparatus which ejects liquid including a material such as an electrode material, or a color material which is used when manufacturing, for example, a liquid display, an EL (electroluminescence) display, a plane emission display, a color filter, or the like, an image recording apparatus which ejects a biological organic substance which is used when manufacturing a biochip, an image recording apparatus which ejects liquid as a sample which is used as precision pipette, a textile printing device, a micro-dispenser, or the like. Further, the image recoding apparatus may be an image recoding apparatus which ejects a lubricant to a precision machine such as a clock, a camera, or the like, using a pinpoint, an image recoding apparatus which ejects transparent resin liquid such as UV curable resin for forming a micro bulls-eye (optical lens) which is used in an optical communication element, or the like, onto a substrate, and an image recoding apparatus which ejects etching liquid such as acid or alkali for etching a substrate or the like. In addition, it is possible to apply the invention to any one of these image recording apparatuses.

This application claims the benefit of Japanese Patent Application No. 2011-176204 filed on Aug. 11, 2011, which is hereby incorporated by reference herein in its entirety.

What is claimed is:

1. An image recording apparatus comprising:

a transport unit which transports a medium with a joint portion along a transport path;

a head unit which performs recording of a printing image on both the joint portion and a non-joint portion by ejecting liquid onto the medium;

a heating unit which dries liquid forming the printing image by heating a portion of the medium located at a heating region on the transport path;

a detection unit which detects the joint portion; and a controller which controls transporting of the medium by the transport unit so that a heating time of the joint portion in the heating region becomes longer than a heating time of the non-joint portion in the heating region on the basis of a detection signal from the detection unit;

wherein the transport unit intermittently transports the medium in the transport direction, and the heating unit heats the joint portion when the joint portion is located at the heating region at the time of moving and stopping the medium, wherein the head unit performs printing operation by ejecting liquid onto a portion of the medium which is located at an image recording region on the transport path by performing a plurality of reciprocations along the transport direction while the heating unit is heating the joint portion which is located at the heating region when the medium is stopped, wherein the heating unit continuously heats the joint portion for a predetermined time even after the printing operation is completed, and then the transport unit restarts transporting of the medium thereafter, and wherein the controller changes the predetermined time according to the number of reciprocations.

2. The image recording apparatus according to claim 1, wherein the joint portion includes a material which is different from that of the non-joint portion, and is a film.

3. An image recording method comprising:

preparing for an image recording apparatus including a transport unit which transports a medium with a joint portion along a transport direction, a head unit which records a printing image on both the joint portion and a non-joint portion by ejecting liquid onto the medium, a heating unit which dry liquid forming the printing image by heating a portion of the medium which is located at a heating region on the transport path, a detection unit which detects the joint portion, and a controller; and controlling transporting of the medium by the transport unit so that a heating time of the joint portion in the heating region becomes longer than a heating time of the non-joint portion in the heating region on the basis of a detection signal from the detection unit;

wherein the transport unit intermittently transports the medium in the transport direction, and the heating unit heats the joint portion when the joint portion is located at the heating region at the time of moving and stopping the medium, wherein the head unit performs printing operation by ejecting liquid onto a portion of the medium which is located at an image recording region on the transport path by performing a plurality of reciprocations along the transport direction while the heating unit is heating the joint portion which is located at the heating region when the medium is stopped, wherein the heating unit continuously heats the joint portion for a predetermined time even after the printing operation is completed, and then the transport unit restarts transporting of the medium thereafter, and controlling changes to the predetermined time according to the number of reciprocations.

4. The image recording method according to claim 3, wherein the joint portion includes a material which is different from that of the non-joint portion, and prepares for a medium of which the material is film.

* * * * *